US009133804B2

(12) United States Patent
Lamm

(10) Patent No.: US 9,133,804 B2
(45) Date of Patent: Sep. 15, 2015

(54) SYSTEM FOR FEEDING FUEL FROM A TANK TO AN INTERNAL COMBUSTION ENGINE

(75) Inventor: Marco Lamm, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 737 days.

(21) Appl. No.: 13/517,146

(22) PCT Filed: Nov. 30, 2010

(86) PCT No.: PCT/EP2010/068468

§ 371 (c)(1),
(2), (4) Date: Jun. 19, 2012

(87) PCT Pub. No.: WO2011/076526

PCT Pub. Date: Jun. 30, 2011

(65) Prior Publication Data

US 2012/0266849 A1 Oct. 25, 2012

(30) Foreign Application Priority Data

Dec. 22, 2009 (IT) ..... MI2009A2271

(51) Int. Cl.
*F02M 37/04* (2006.01)
*F02M 63/00* (2006.01)
(Continued)

(52) U.S. Cl.
CPC ..... *F02M 63/0001* (2013.01); *F02M 59/06* (2013.01); *F02M 59/102* (2013.01);
(Continued)

(58) Field of Classification Search
CPC ..... F02M 37/0047; F02M 37/04; F02M 37/0052; F02M 39/005
USPC ..... 123/510, 511, 514
See application file for complete search history.

(56) References Cited

U.S. PATENT DOCUMENTS 2,787,224 A * 4/1957 Udale ..... 418/206.7
4,078,529 A * 3/1978 Warwick ..... 123/44 C
(Continued)

FOREIGN PATENT DOCUMENTS

EP 1389683 2/2004
JP 2005256735 9/2005
(Continued)

OTHER PUBLICATIONS

PCT/EP2010/068468 International Search Report dated Jan. 12, 2011 (3 pages).

*Primary Examiner* — Thomas Moulis
(74) *Attorney, Agent, or Firm* — Michael Best & Friedrich LLP

(57) ABSTRACT

A system (1) for feeding fuel from a tank (2) to an internal combustion engine (3) has:—an electrically actuated pre-feed variable-flow electric pump (9); —a high-pressure piston pump (10) having a pump casing (15) and piston movement mechanism (17) housed in the pump casing (16); and—a hydraulic circuit (7) comprising a first branch (11) for connecting the tank (2) to the pre-feed pump (9), a second branch (12) for connecting the pre-feed pump (9) to the high-pressure piston pump (10) and a third branch (13) for connecting the high-pressure piston pump (10) to the internal combustion engine (3); wherein the second branch (12) is configured to branch downstream of the pre-feed pump (9) into a first channel (12*a*) structured for conveying part of the fuel to the intake of the high-pressure piston pump (10) and for connecting the pre-feed pump (9) directly to the intake of the high-pressure piston pump (10), and into a second channel (12*b*) structured for conveying part of the fuel in the casing (15) and for connecting the pre-feed pump (9) to the casing (15) making the fuel flow solely through at least one calibrated hole (27).

8 Claims, 3 Drawing Sheets

(51) Int. Cl.

| | |
|---|---|
| ***F02M 59/06*** | (2006.01) |
| ***F02M 59/10*** | (2006.01) |
| ***F02M 63/02*** | (2006.01) |
| *F02M 39/00* | (2006.01) |
| *F02M 37/00* | (2006.01) |

(52) U.S. Cl.

CPC ..... *F02M63/0265* (2013.01); *F02M 37/0047* (2013.01); *F02M 37/0052* (2013.01); *F02M 37/04* (2013.01); *F02M 39/005* (2013.01)

(56) References Cited

U.S. PATENT DOCUMENTS

| | | | | | |
|---|---|---|---|---|---|
| 4,301,777 | A | * | 11/1981 | Grundman et al. | 123/379 |
| 4,476,836 | A | * | 10/1984 | Enomoto et al. | 123/502 |
| 5,630,708 | A | * | 5/1997 | Kushida et al. | 417/273 |
| 5,967,123 | A | * | 10/1999 | Ruoff et al. | 123/495 |
| 6,009,854 | A | * | 1/2000 | Rosgren et al. | 123/456 |
| 6,186,120 | B1 | | 2/2001 | Guentert et al. | |
| 6,345,609 | B1 | * | 2/2002 | Djordjevic | 123/509 |
| 6,457,957 | B1 | * | 10/2002 | Bauer et al. | 417/562 |
| 6,694,950 | B2 | * | 2/2004 | Djordjevic | 123/446 |
| 6,722,864 | B2 | | 4/2004 | Suzuki et al. | |
| 6,796,778 | B2 | * | 9/2004 | Utsumi | 417/441 |
| 7,134,846 | B2 | * | 11/2006 | Djordjevic | 417/273 |
| 8,205,596 | B2 | | 6/2012 | Kieferle et al. | |
| 2002/0189436 | A1 | * | 12/2002 | Frank et al. | 92/61 |
| 2004/0179950 | A1 | | 9/2004 | Kuroda | |
| 2006/0239847 | A1 | * | 10/2006 | Maier et al. | 417/562 |

FOREIGN PATENT DOCUMENTS

| | | |
|---|---|---|
| RU | 2087739 | 8/1997 |
| SU | 347445 | 9/1970 |
| WO | 2006134002 | 12/2006 |
| WO | 2009121823 | 10/2009 |
| WO | 2009141188 | 11/2009 |

* cited by examiner

SYSTEM FOR FEEDING FUEL FROM A TANK TO AN INTERNAL COMBUSTION ENGINE

BACKGROUND OF THE INVENTION

The present invention concerns a system for feeding fuel from a tank to an internal combustion engine.

More specifically, the present invention concerns a system for feeding diesel fuel from a tank to a diesel combustion engine; application to which the following description refers purely by way of example without this implying any loss of generality.

As is known, the systems for feeding diesel fuel to a diesel combustion engine normally include:

a low-pressure pump or pre-feed pump, a high-pressure piston pump, and a hydraulic circuit which is provided with a first branch structured to connect the fuel tank to the pre-feed pump, a second branch structured to connect the pre-feed pump to the high-pressure piston pump and a third branch structured to connect the high-pressure piston pump to the internal combustion engine.

More specifically, in the case of diesel internal combustion engines, the third branch of the hydraulic circuit is able to connect the delivery of the high-pressure piston pump to the fuel distribution manifold, commonly known as the "common rail", which branches off into injectors which are structured to atomise, on command, the diesel fuel inside the various combustion chambers of the internal combustion engine.

Since the pre-feed pump is a constant-flow electric pump, the system for feeding fuel also comprises an electrically operated shutter valve and a mechanical overpressure valve, placed in parallel along the second branch of the hydraulic circuit.

More specifically, the second branch of the hydraulic circuit branches, downstream of the delivery of the prefeed pump, into two separate channels which reach the high-pressure piston pump separately one from the other. The electrically operated shutter valve is positioned along the channel that communicates directly with the high-pressure piston pump intake, while the over-pressure valve is connected along the channel that communicates with the chamber of the high-pressure piston pump that houses the piston movement mechanism.

The shutter valve is able to continuously regulate the flow of diesel fuel that, moment by moment, flows to the intake throat of the high-pressure piston pump and is piloted by an electronic control unit in a manner such that, moment by moment, a quantity of diesel fuel substantially equal to the instantaneous need of the combustion engine is made to flow to the intake mouth of the high-pressure piston pump, while the over-pressure valve stabilizes the pressure of the diesel fuel upstream of the shutter valve, automatically diverting excess diesel fuel to the chamber of the high-pressure piston pump that houses a piston movement mechanism, so that the diesel fuel can lubricate and cool the mechanical members housed therein.

In recent years, the need to make lighter and more compact the part of the fuel feed system destined to be housed in the vehicle's engine compartment, has driven the majors manufacturers of this type of fuel systems to obtain the two channels of the second branch of the hydraulic circuit directly inside the casing of the high-pressure piston pump, together with the seats that house the shutter valve and the over-pressure valve.

Unfortunately, this need has rendered assembly of the high-pressure piston pump much more complicated; with a consequent increase in production costs with respect to diesel fuel feed systems of greater bulk.

SUMMARY OF THE INVENTION

The aim of the present invention is that of realizing a system for feeding diesel fuel from a tank to a diesel combustion engine, which is more compact and lighter than current ones and is also cheaper to produce.

In compliance with these aims, according to the present invention there is provided a system for feeding fuel from a tank to an internal combustion engine; the system comprising:

an electrically actuated pre-feed variable-flow pump;

a high-pressure piston pump having a pump casing and piston movement mechanism housed in the pump casing; and a hydraulic circuit comprising a first branch for connecting the tank to the pre-feed pump, a second branch for connecting the pre-feed pump to the high-pressure piston pump and a third branch for connecting the high-pressure piston pump to the internal combustion engine; wherein the second branch of the hydraulic circuit is configured so as to branch downstream of the pre-feed pump into a first channel structured for conveying part of the fuel to the intake of the high-pressure piston pump and for connecting the pre-feed pump directly to the intake of the high-pressure piston pump, and into a second channel structured for conveying part of the fuel in the casing and for connecting the pre-feed pump to the casing making the fuel flow solely through at least one calibrated hole. In this way, the fuel supply system no longer requires an electrically controlled shutter valve and a mechanical over-pressure valve on the second branch of the hydraulic circuit, with a consequent drastic reduction in the bulk and production costs of the system. Making the calibrated hole inside the pump casing of the high-pressure piston pump is, in fact, much simpler than inserting a mechanical over-pressure valve or a lubrication valve in the pump casing.

BRIEF DESCRIPTION OF THE DRAWINGS

Further characteristics and advantages of the present invention will become clear from the description that follows and refers to the enclosed drawings, which illustrate a non-limitative embodiment, where:

FIG. 2 is a lateral view, with parts in cross-section and parts removed for clarity, of a detail of the system shown in FIG. 1, while

DETAILED DESCRIPTION

Figure 1:
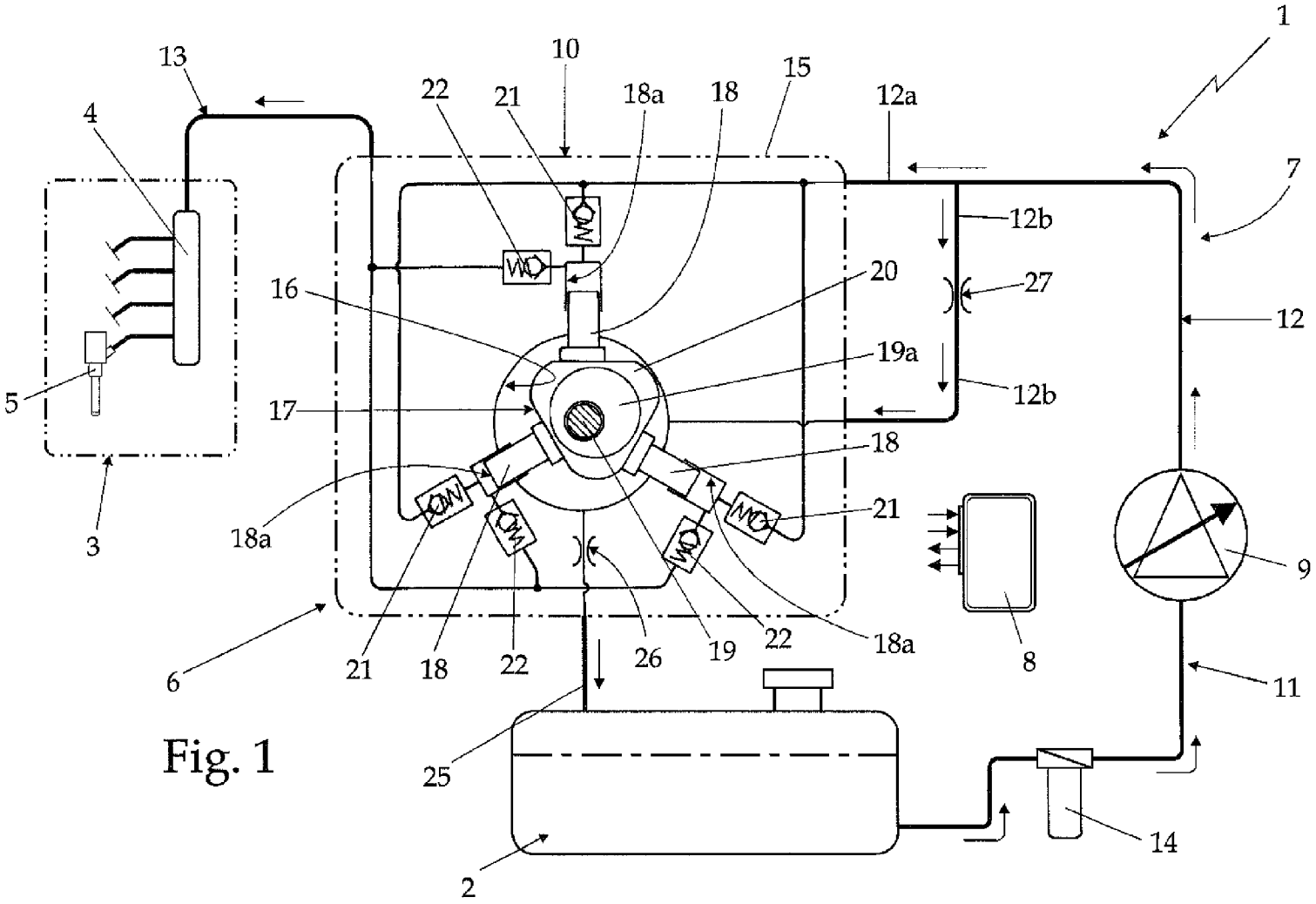
FIG. 1 is a schematic view, with parts removed for clarity, of a system for feeding fuel from a tank to an internal combustion engine embodied according to the principles of the present invention.

With reference to FIG. 1, reference numeral 1 indicates, in its entirety, a system for feeding fuel, in this case diesel fuel, from a tank 2 to an internal combustion engine 3 of known type.

More specifically, the internal combustion engine 3 is a diesel internal combustion engine that comprises a fuel distribution manifold 4, commonly known as a "common rail", which is structured to hold fuel at a pressure preferably, but not necessarily, greater than 1800 bar; and a number of electrically-operated injectors 5 which are directly connected to the manifold 4 and are able, on command, to atomize the fuel inside the various combustion chambers (not shown) of the internal combustion engine.

With reference to FIG. 1, the fuel feed system 1 basically comprises a fuel pump assembly 6; a hydraulic circuit 7 which is able to connect the fuel pump assembly 6 to both the tank 2 and the internal combustion engine 3; and a control unit 8, namely an electronic control unit, which is configured for determining the fuel need of the internal combustion engine 3 moment by moment and for piloting certain components of the fuel feed system 1 so as to supply to the fuel distribution manifold 4 a fuel amount substantially equal to the instantaneous need of the internal combustion engine 3.

More specifically, the fuel pump assembly 6 comprises a low-pressure or pre-feed pump 9 and a high-pressure piston pump 10 placed in series along the hydraulic circuit 7, while the hydraulic circuit 7 comprises a first branch 11 able to connect the tank 2 to the pre-feed pump 9, a second branch 12 able to connect the pre-feed pump 9 to the high-pressure piston pump 10 and a third branch 13 able to connect the high-pressure piston pump 10 to the fuel distribution manifold 4 of the internal combustion engine 3.

Preferably, but not necessarily, the hydraulic circuit 7 is also equipped with at least one fuel filter 14 positioned on the connection branch 11, upstream (or in a not shown embodiment downstream) of the pre-feed pump 9.

With reference to FIG. 1, in particular, the prefeed pump 9 is a variable flow electric pump, which is suitable for being directly piloted by the electronic control unit 8 of the fuel feed system so as to suck a quantity of fuel from the tank 2 and convey it to the high-pressure piston pump 10 that, moment by moment, approximates by excess to the instantaneous fuel need of the internal combustion engine 3, while the high-pressure piston pump 10 is equipped with an outer or pump casing 15 defining a closed chamber 16 destined to house a piston movement mechanism 17. Alternatively the pre-feed pump 9 can be an electric controllable vane pump or an internal- or external gear pump with e.g. an electrical precontrol.

More specifically, with reference to FIG. 1, the high-pressure piston pump 10 is provided with a plurality of pistons 18 (three in the example shown) that are angularly distributed about chamber 16 and are each inserted in an axially sliding and fluid-tight manner inside a respective cylindrical cavity 18*a* that terminates inside chamber 16.

The piston movement mechanism 17, instead, comprises a rotating shaft 19 that is suitable for being driven in rotation by the engine drive shaft (not shown) of the internal combustion engine 3 and is equipped with an eccentric portion 19*a* that is mobile inside the chamber 16 of the pump casing 15 and a polygonal ring 20 that is fitted in a freely rotating manner on the eccentric portion 19*a* of the shaft 19, so that it can orbit inside the chamber 16 of the pump casing 15 when the shaft 19 turns about its longitudinal axis L. Alternatively, the present invention applies for high-pressure piston pumps with e.g. roller drive instead of a polygonal ring drive.

For each piston 18, the high-pressure piston pump 10 also comprises a respective return coil spring (not shown) designed for keeping the bottom end of the piston 18 always in contact with the periphery of the polygonal ring 20, so as to constrain the piston 18 to move with alternating rectilinear motion inside the cylindrical cavity 18*a* during the rotary translational motion of the polygonal ring 20 inside the chamber 16 of the pump casing 15.

Finally, with reference to FIG. 1, for each cylindrical cavity 18*a*, the high-pressure piston pump 10 comprises at least one feed valve 21 and at least one delivery valve 22, selectively able to place the cylindrical cavity 18*a* in communication respectively with branch 12 and with branch 13 of the hydraulic circuit 7. More specifically, the feed valve 21 is a check valve structured so as to regulate the passage of fuel from branch 12 of the hydraulic circuit 7 to the cylindrical cavity 18*a* of the high-pressure piston pump 10, while the delivery valve 22 is a check valve structured so as to regulate the passage of fuel from the cylindrical cavity 18*a* of the high-pressure piston pump 10 to branch 13 of the hydraulic circuit 7.

In the example shown, the feed valves 21 and the delivery valves 22 are built into the pump casing 15 and shall not be described any further as they are widely known within the sector.

Figure 2:
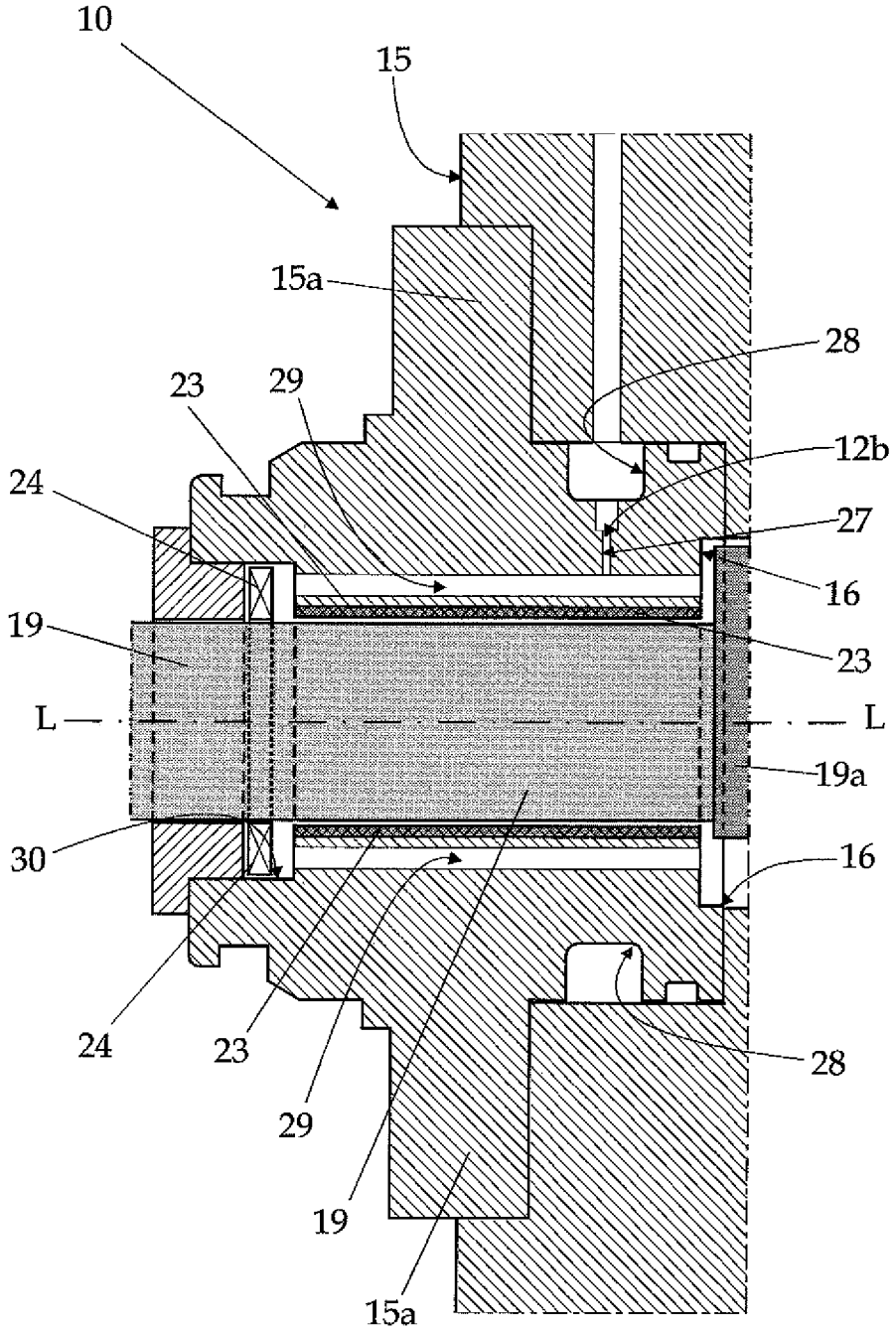

With reference to FIGS. 1 and 2, the shaft 19 of the high-pressure piston pump 10, instead, extends through the chamber 16 that houses the piston movement mechanism 17 and is mounted to axially rotate inside the pump casing 15 by the interposition of special lateral support bearings 23, in this case bushings 23, positioned on opposite sides of the chamber 16. Furthermore, one of the two ends of the shaft 19 projects outside the pump casing 15 so that it can be connected to the engine drive shaft (not shown) of the internal combustion engine 3.

With reference to FIG. 2, to avoid fuel leaking outside the pump casing 15, the high-pressure piston pump 10 is preferably, but not necessarily, also provided with an annular sealing gasket 24 that is fitted on the rotating shaft 19, immediately downstream of the bushing 23 that delimits and supports the projecting portion of the shaft 19, namely the portion of the shaft that projects outside the pump casing 15.

In other words, the annular sealing gasket 24 is positioned inside the pump casing 15, next to the bushing 23 that supports the projecting portion of the shaft 19, on the opposite side of the chamber 16 that houses the rest of the piston movement mechanism 17.

More specifically, in the example shown, the pump casing 15 comprises a flanged support hub 15*a* that is structured so as to delimit and hermetically seal the chamber 16 of the pump casing 15, and to house within itself the bushing 23 that directly supports the projecting portion of the shaft 19 and possibly the annular sealing gasket 24.

With reference to FIGS. 1 and 2, branch 12 of the hydraulic circuit 7 is structured to branch downstream of the pre-feed pump 9 into two channels 12*a* and 12*b* that run separately from each other to the high-pressure piston pump 10. Channel 12*a* is able to convey part of the fuel arriving from the pre-feed pump delivery to the intake of the high-pressure piston pump 10, while channel 12*b* conveys part of the fuel to the chamber 16 for lubricating and cooling the piston movement mechanism 17.

The hydraulic circuit 7 also comprises a fourth connection branch 25 for connecting the chamber 16 to the tank 2 and draining off the fuel used to lubricate and/or cool the piston movement mechanism 17 back to the tank 2.

Optionally, the hydraulic circuit 7 can also be equipped with a calibrated hole 26 or a check valve, which is placed along branch 25.

However, unlike currently known fuel-feed systems, channel 12*a* of branch 12 is structured so as to connect the pre-feed pump 9 delivery directly (i.e. without the interposition of any flow control valve) to the intake of the high-pressure piston pump 10, while channel 12*b* of branch 12 is structured so as to connect the pre-feed pump 9 delivery to the chamber 16 that houses the piston movement mechanism 17, forcing the fuel to only flow through at least one calibrated hole 27 that has the function of reducing the pressure and limiting the max fuel quantity flow to the chamber 16 of the pump casing 15.

In other words, the delivery of the pre-feed pump 9 is separated from the chamber 16 that houses the piston movement mechanism 17 by only one or more calibrated holes 27 (one in the example shown), which have the function of reducing the pressure and limiting the max fuel quantity flow to the chamber 16 of the pump casing 15.

More specifically, with reference to FIG. 2, in the example shown, the feed valves 21 of the high-pressure piston pump 10 are connected together and to branch 12 of the hydraulic circuit 7 by means of an external annular channel 28 that is obtained directly on the outer surface of the flanged hub 15*a*, close to the chamber 16. The annular channel 28 is preferably, but not necessarily, coaxial with the longitudinal axis L of the shaft 19 and the hub 15*a*, and encircles the bushing 23 that, in turn, is placed at the centre of the hub 15*a*, coaxial with the longitudinal axis L of the shaft 19.

The flanged hub 15*a* is also equipped with one or more longitudinal through channels 29 that extend within the body of the hub parallel to the longitudinal axis L of the shaft 19 and the hub 15*a*, between the external annular channel 28 and the underlying bushing 23, so as to put the seat 30 that houses the annular sealing gasket 24 in direct communication with the chamber 16 of the pump casing 15 that houses the piston movement mechanism 17, so as to lubricate and/or cool the bushing 23 on both sides. Channel 12*b* is defined by a rectilinear through hole preferably, but not necessarily, of variable diameter, which extends radially in the body of the flanged hub 15*a*, from the bottom of the annular channel 28 to the longitudinal through channel 29.

In this way, the fuel that fills the annular channel 28 can drain into the rectilinear through hole until it reaches the longitudinal through channel 29, and from here continues to the chamber 16 that houses the piston movement mechanism 17 and/or to the seat 30 that houses the annular sealing gasket 24.

The section of the rectilinear through hole having the smallest diameter defines the calibrated hole 27, which has the function of reducing the pressure and limiting the max fuel quantity flow to the chamber 16 of the pump casing 15.

Figure 3:
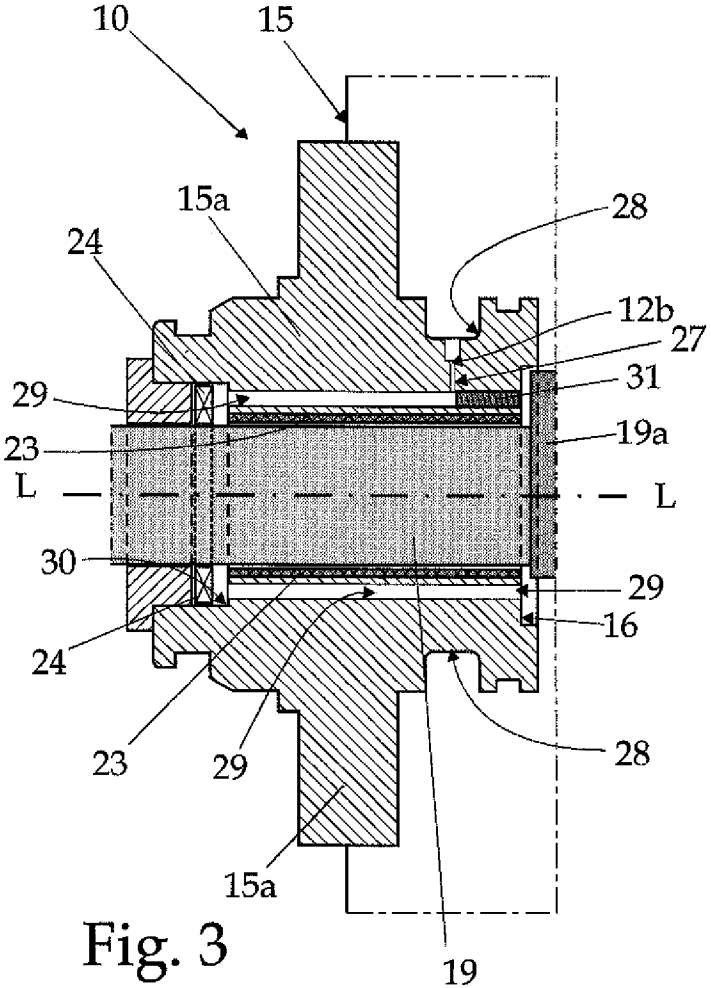

With reference to FIG. 3, in correspondence to one of the two ends of the longitudinal through channel 29 that communicates directly with the rectilinear through hole 12, the flanged hub 15*a* can comprise a plug body 31 that forms a fluid-tight seal at one of the two ends of the longitudinal through channel 29 that is directly connected to the through hole. In this way, all of the fuel that drains through the rectilinear through hole is forced to come out at only one end of the longitudinal through channel 29.

By positioning the plug body 31 at the end of the longitudinal through channel 29 giving onto the chamber 16 of the pump casing 15 (see FIG. 3), it is possible to favour the lubrication and/or cooling of the bushing 23 and the annular sealing gasket 24. Instead, by positioning the plug body 31 at the end of the longitudinal through channel 29 giving onto the seat 30 that houses the annular sealing gasket 24, it is possible to favour the lubrication and/or cooling of the piston movement mechanism 17 housed inside the chamber 16 of the pump casing 15.

The operation of the fuel feed system 1 is easily deduced from that described above and therefore does not necessitate further explanation. Except for clarifying that the electronic control unit 8 is configured to pilot the variable flow pre-feed pump 9 on the basis of signals arriving from a series of sensors for measuring certain physical quantities related to the running of the internal combustion engine 3, so as to adjust the flow of the pump based on the instantaneous fuel need of the internal combustion engine 3.

More specifically, the electronic control unit 8 is configured to adjust, moment by moment, the flow of the pre-feed pump 9 so as to always send the quantity of fuel to the high-pressure piston pump 10 that is needed to meet the instantaneous fuel need of the internal combustion engine 3 and to lubricate and/or cool the piston movement mechanism 17.

The advantages deriving from the structure of the fuel feed system 1 are many.

First of all, the elimination of the shutter valve and the over-pressure and/or lubrication valve from branch 12 of the hydraulic circuit 7 permits a drastic reduction in production costs for the system. The calibrated hole 27 is in fact very simple to make inside the pump casing 15 of the high-pressure piston pump 10.

In addition, making channel 12*b* and the calibrated hole 27 directly on the bottom of the annular channel 28 present on the outer surface of the flanged hub 15*a* permits a significant reduction in the weight and bulk of the flanged hub 15*a*, also permitting drastic simplification of the production process for the high-pressure piston pump 10, with the reduction of production costs that this entails.

Lastly, it is obvious that changes to and variants of the fuel feed system 1 can be made without departing from the scope of the present invention.

Figure 4:
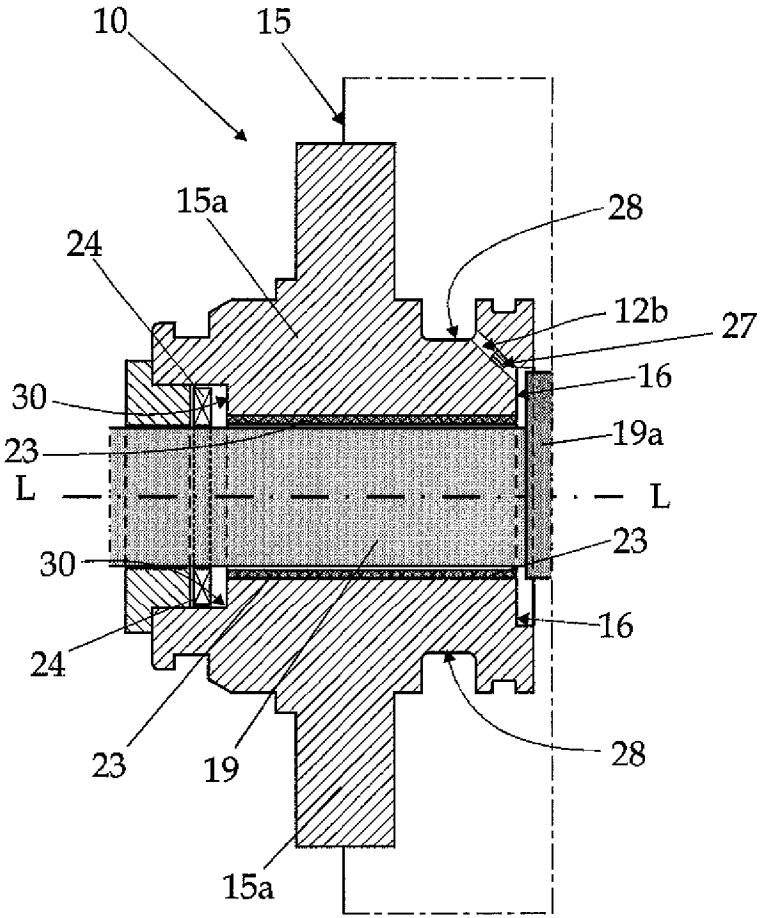
FIGS. 3 and 4 are two lateral views, with parts in cross-section and parts removed for clarity, of two embodiments of the system of FIG. 1.

For example, with reference to FIG. 4, regardless of the presence or absence of the longitudinal through channels 29 in the flanged hub 15*a*, channel 12*b* can be constituted by a transversal rectilinear through hole 12*b* that extends from the bottom of the annular channel 28 directly to the chamber 16 that houses the piston movement mechanism 17. In this case, the section of rectilinear through hole 12*b* that has the smallest diameter forms the calibrated hole 27.

Furthermore, in all of the above-described embodiments, the calibrated hole 27 may made into bushing or threaded insert placed along a section of the rectilinear through hole.

The invention claimed is:

1. A system (1) for feeding fuel from a tank (2) to an internal combustion engine (3); the system comprising:

an electrically actuated pre-feed variable-flow pump (9);

a high-pressure piston pump (10) having a pump casing (15) and a piston movement mechanism (17) housed in the pump casing (15); and a hydraulic circuit (7) comprising a first branch (11) for connecting the tank (2) to the pre-feed pump (9), a second branch (12) for connecting the pre-feed pump (9) to the high-pressure piston pump (10) and a third branch (13) for connecting the high-pressure piston pump (10) to the internal combustion engine (3); wherein the second branch of the hydraulic circuit (7) is structured so as to branch downstream of the pre-feed pump (9) into a first channel (12*a*) structured for conveying part of the fuel to the intake of the high-pressure piston pump (10) and for connecting the pre-feed pump (9) directly to the intake of the high-pressure piston pump (10), and into a second channel (12*b*) structured for conveying part of the fuel in the casing (15) and for connecting the pre-feed pump (9) to the casing (15) making the fuel flow solely through at least one calibrated hole (27).

2. The system for feeding fuel according to claim 1 comprising a control unit (8) configured for piloting the pre-feed variable flow pump (9) and adjusting the flow of the pre-feed variable flow pump (9) as a function of an in-stantaneous fuel need of the internal combustion engine (3).

3. The system for feeding fuel according to claim 1, wherein the piston movement mechanism (17) comprises a rotating shaft (19) that crosses the casing (15) and is mounted to axially rotate inside a chamber (16) of the casing (15), which comprises a support hub (15*a*) structured to delimit and seal the chamber (16) of the pump casing (15), and equipped with an external annular channel (28) that is suitable to place feed valves (21) of the high-pressure piston pump (10) in communication with each other and with the second branch (12) of the hydraulic circuit (7); the second channel (12*b*) of the second branch (12) of the hydraulic circuit (7) being defined by a through hole extending within a body of the support hub (15*a*) between the annular channel (28) and the chamber (16); a section of said through hole forming said at least one calibrated hole (27).

4. The system for feeding fuel according to claim 3, wherein the support hub (15*a*) is equipped on a side of a support bearing (23) with a seat (30) for housing an annular sealing gasket (24) and is equipped with at least one connection through channels (29) that extend within the body of the hub (15*a*) between the external annular channel (28) and an underlying bearing (23) so as to put the seat (30) that houses the annular sealing gasket (24) in direct communication with the chamber (16); the second channel (12*b*) of the second branch (12) extending within from the external annular channel (28) to the connection through channel (29).

5. The system for feeding fuel according to claim 4, wherein the support hub (15*a*) comprises a plug body (31) for forming a fluid-tight seal at one of the two ends of the connection through channel (29).

6. The system for feeding fuel according to claim 3, wherein the through hole forming the second channel (12*b*) of the second branch (12) is rectilinear.

7. The system for feeding fuel according to claim 1, wherein the hydraulic circuit (7) comprises a fourth branch (25) for connecting the casing (15) to the tank (2).

8. The system for feeding fuel according to claim 7, wherein the hydraulic circuit (7) comprises choking means (26), along the fourth branch (25) of the hydraulic circuit (7).

* * * * *